US006022252A

United States Patent [19]

Ozawa

[11] Patent Number: 6,022,252

[45] Date of Patent: Feb. 8, 2000

[54] BREATHER ARRANGEMENT FOR WATERCRAFT ENGINE

[75] Inventor: Shigeyuki Ozawa, Iwata, Japan

[73] Assignee: Yamaha Hatsudoki Kabushiki Kaisha, Iwata, Japan

[21] Appl. No.: 09/042,141

[22] Filed: Mar. 13, 1998

[30] Foreign Application Priority Data

Mar. 13, 1997 [JP] Japan ..... 9-082211

[51] Int. Cl.[7] ..... B63H 21/38

[52] U.S. Cl. ..... 440/88; 123/572

[58] Field of Search ..... 440/88; 181/214, 181/229; 123/572

[56] References Cited

U.S. PATENT DOCUMENTS

| | | | |
|---|---|---|---|
| 3,170,447 | 2/1965 | Svoren et al. | 123/572 |
| 3,179,095 | 4/1965 | Linn | 123/572 |
| 3,889,649 | 6/1975 | Polaner | 123/572 |
| 4,319,657 | 3/1982 | Nomura et al. | 181/229 |
| 4,856,486 | 8/1989 | Mori et al. | 123/572 |
| 4,945,887 | 8/1990 | Sakurai et al. | 123/573 |
| 5,340,344 | 8/1994 | Mineo et al. | 440/88 |

*Primary Examiner*—Sherman Basinger

*Attorney, Agent, or Firm*—Knobbe, Martens, Olson & Bear LLP

[57] ABSTRACT

A breather arrangement for an engine powering a water propulsion device of a watercraft having a hull defining an engine compartment in which the engine is positioned is disclosed. The engine has a body defining at least one combustion chamber and has an output shaft arranged to drive the water propulsion device. The engine includes an intake system through which air is supplied to the combustion chamber, the intake system including an air intake pipe extending from the body of the engine to an air box having a top surface and a bottom surface and an air inlet leading into an interior air space. The breather includes a passage leading from the engine body to an opening in fluid communication with the intake system, the opening positioned at other than the top or bottom surface of the air box.

5 Claims, 8 Drawing Sheets

BREATHER ARRANGEMENT FOR WATERCRAFT ENGINE

FIELD OF THE INVENTION

The present invention relates to an engine of the type used to power a watercraft. More particularly, the invention is a breather arrangement for such an engine.

BACKGROUND OF THE INVENTION

Internal combustion engines are commonly used to power small watercraft such as personal watercraft. These watercraft include a hull which defines an engine compartment. The engine is positioned in the engine compartment. The output shaft of the engine is coupled to a water propulsion device of the watercraft, such as an impeller.

Air must be supplied to the engine from outside the hull for use in the combustion process. Typically, air flows through one or more ducts in the hull into the engine compartment, and then through an intake system of the engine to the combustion chamber(s) thereof.

The engine may include one or more breather pipes. The breather pipe typically extends from a camshaft chamber to the intake system of the engine. In this manner, blowby gas, i.e., intake and exhaust gas which passes from the combustion chamber to the camshaft chamber, such as along the valve stem, is relieved.

A problem arises in that the intake system is often arranged so that water often enters the intake system of the engine. This water may enter the breather pipe and flow to the engine, possibly damaging the engine.

An improved breather arrangement for an engine powering a watercraft is desired.

SUMMARY OF THE INVENTION

In accordance with the present invention there is provided a breather arrangement for an engine. Preferably, the engine has an output shaft arranged to power a water propulsion device of a watercraft. The watercraft has a hull defining an engine compartment in which the engine is positioned.

The engine has a body defining at least one combustion chamber. The engine includes an intake system through which air is supplied to the combustion chamber, the intake system including an air intake pipe extending from the body of the engine to an air box having a top surface and a bottom surface and an air inlet leading into an interior air space.

A breather is provided for routing blowby gas from a portion of the engine body to the intake system. In one arrangement, the breather includes a passage leading from the engine body to an opening in fluid communication with the intake system, the opening positioned at other than the top or bottom surface of the air box.

In another arrangement, the breather is a pipe having an end which is positioned within the air space defined by the intake system.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an arrangement for a breather associated with an engine of the type utilized to power a small watercraft. The breather arrangement is described in conjunction with an engine powering a personal watercraft since this is an application for which the breather has particular utility. Those of skill in the art will appreciate that the breather may have utility in a wide variety of other settings.

Figure 1:
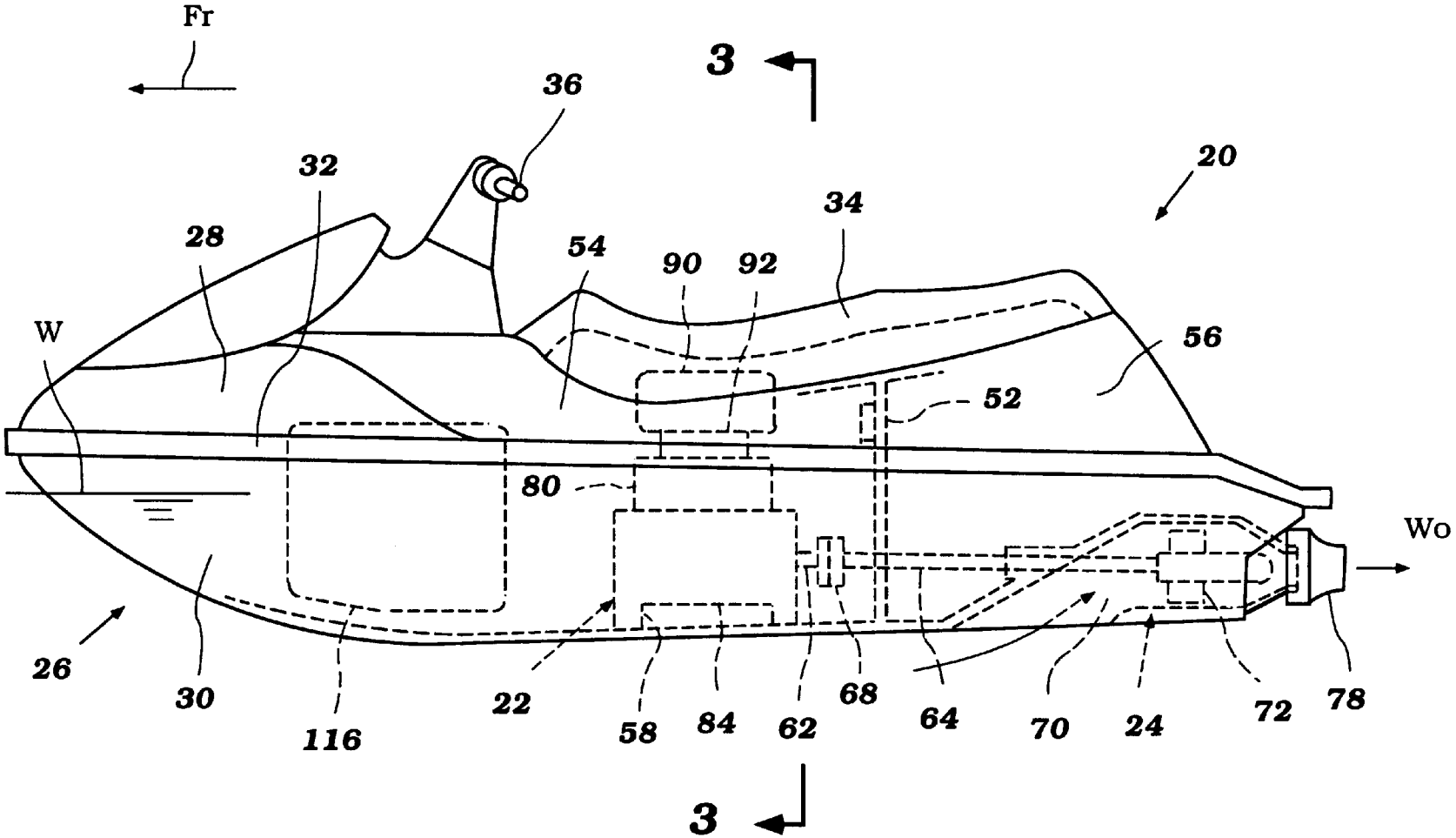
FIG. 1 is a side view of a personal watercraft of the type powered by an engine having a breather arrangement in accordance with a first embodiment of the present invention, the engine and other watercraft components positioned within a hull of the watercraft illustrated in phantom.
Figure 2:
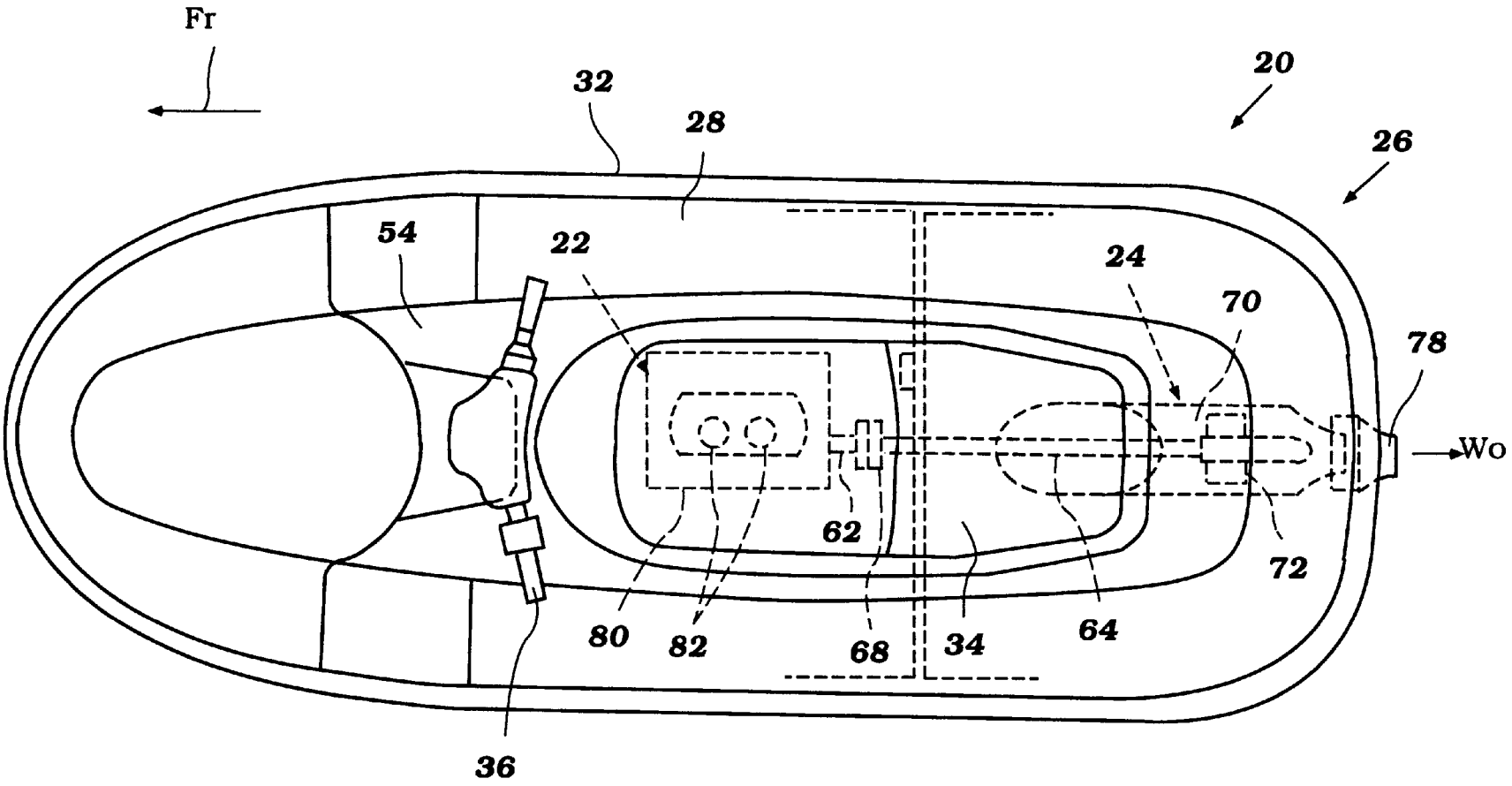
FIG. 2 is a top view of the watercraft illustrated in FIG. 1, with the engine and other watercraft components positioned within the watercraft illustrated in phantom.

FIGS. 1 and 2 illustrate a watercraft 20 having a watercraft body comprising a hull 26 having a top portion or deck 28 and a lower portion 30. A gunnel 32 defines the intersection of the lower portion 30 of the hull 26 and the deck 28. The watercraft 20 is suited for movement through a body of water W in a direction Fr (towards a front end of the watercraft).

A seat 34 is positioned on the top portion 28 of the hull 26. The seat 34 is preferably connected to a first removable deck member. A steering handle 36 is provided adjacent the seat 34 for use by a user in directing the watercraft 20.

Figure 3:
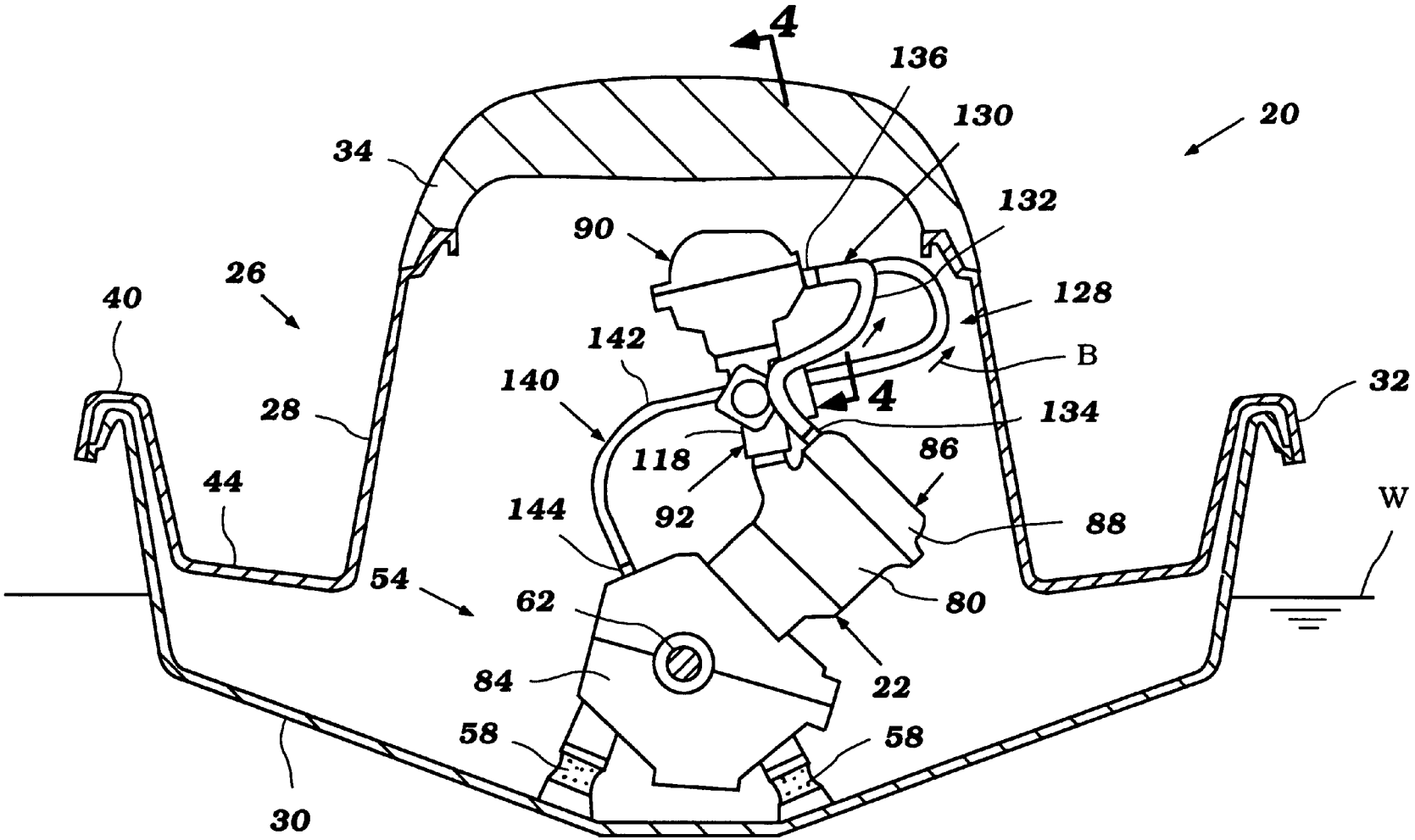
FIG. 3 is a cross-sectional end view of the watercraft illustrated in FIG. 1, taken along line 3—3 therein.

As best illustrated in FIG. 3, a bulwark 40 extends upwardly along each side of the watercraft 20. A foot step area 44 is defined between the seat 34 and the bulwark 40 on each side of the watercraft 20.

The top and bottom portions 28,30 of the hull 26, along with a bulkhead 52, define an engine compartment 54 and a pumping or propulsion unit compartment 56. The engine 22 is positioned in the engine compartment 54. As best illustrated in FIG. 3, the engine 22 is connected to the hull 26 with several engine mounts 58 connected to a bottom 58 the lower portion 30 of the hull 26. The engine 22 is preferably partially accessible through a maintenance opening accessible by removing a deck member on which the seat 34 is mounted.

Referring to FIGS. 1–3, the engine 22 has a crankshaft 62 which is in driving relation with an impeller shaft 64 via a coupling 68. The impeller shaft 64 rotationally drives a means for propelling water of a propulsion unit 24.

Referring to FIGS. 1 and 2, the propulsion unit 24 is preferably a water jet-propulsion unit including a propulsion passage 70 having an intake port which extends through the lower portion 30 of the hull 28. The means for propelling water, preferably an impeller 72 driven by the impeller shaft 64, is positioned in the passage 70. The passage 70 also has an outlet which discharges into a nozzle 78. The nozzle 78 is mounted for movement for directing water Wo which is expelled from the rear or stern of the watercraft 20, whereby the direction of the propulsion force for the watercraft 20, and thus its direction, may be varied. Preferably, the position of the nozzle 78 is controlled with the steering handle 36.

The engine 22 preferably has two cylinders and operates on a four-cycle principle. Of course, the engine 22 may have as few as one, or more than two, cylinders, as may be appreciated by one skilled in the art.

The engine 22 includes an engine or cylinder body 80, preferably comprising a cylinder head connected to a cylinder block, the cylinder body 80 defining two cylinders 82 (see FIG. 2). A piston (not shown) is movably mounted in each cylinder 82 and is connected to the crankshaft 62 via a connecting rod, as is well known in the art.

The crankshaft 62 is partially located within a crankcase 84 of the engine 22 positioned below the engine body 80. Since the engine 22 preferably operates on a four-cycle principle, a number of valves are provided for controlling the flow of air to each cylinder 82 and the flow of exhaust therefrom. These valves may be controlled by one or more camshafts or similar means. The ends of these valves and their operational mechanism 86 is preferably housed in a chamber defined by a head cover 88 connected to the top of the engine body 80.

Figure 4:
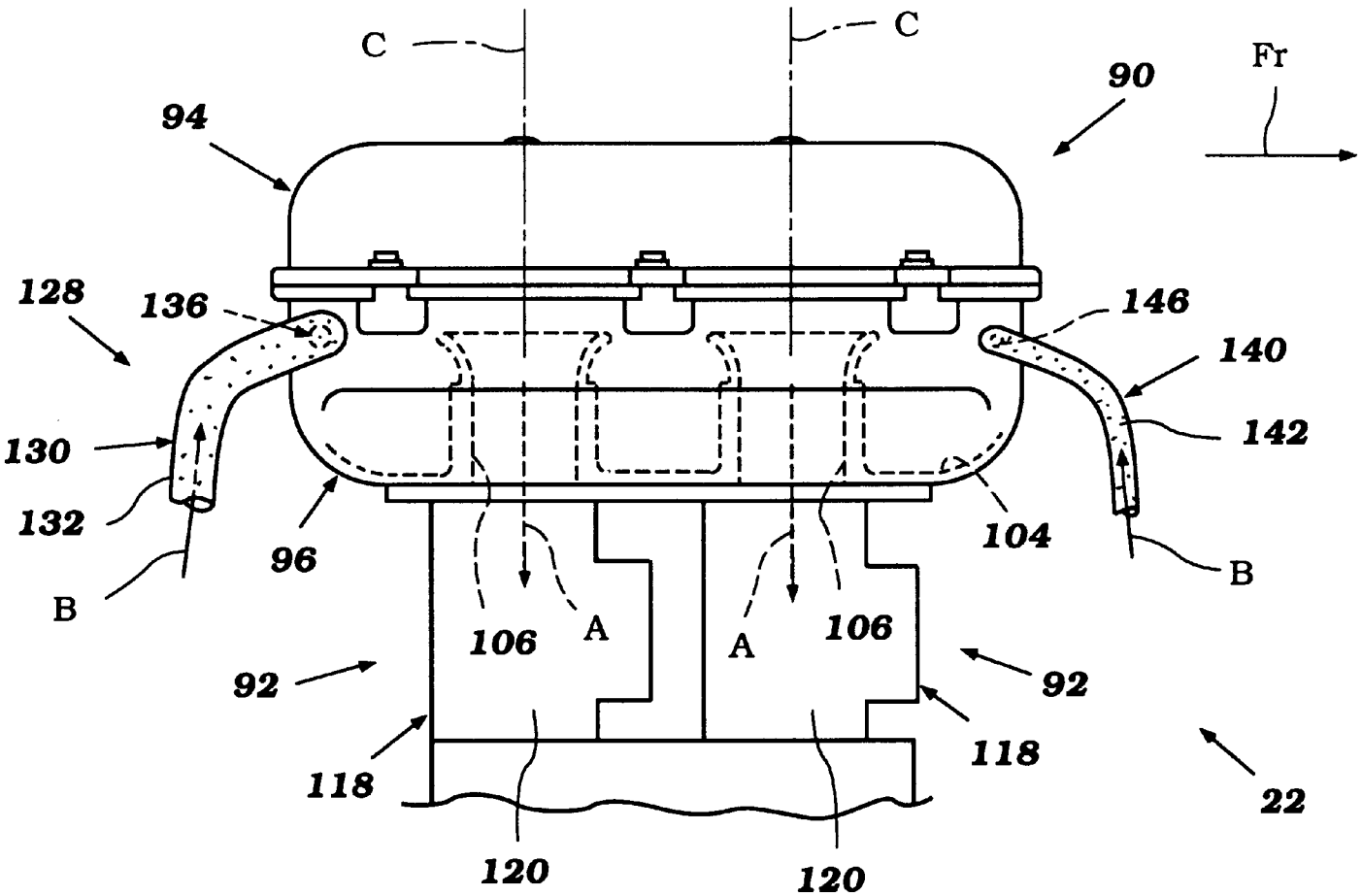
FIG. 4 is a view of an intake system of the engine illustrated in FIG. 3, taken in the direction of line 4—4 therein.
Figure 5:
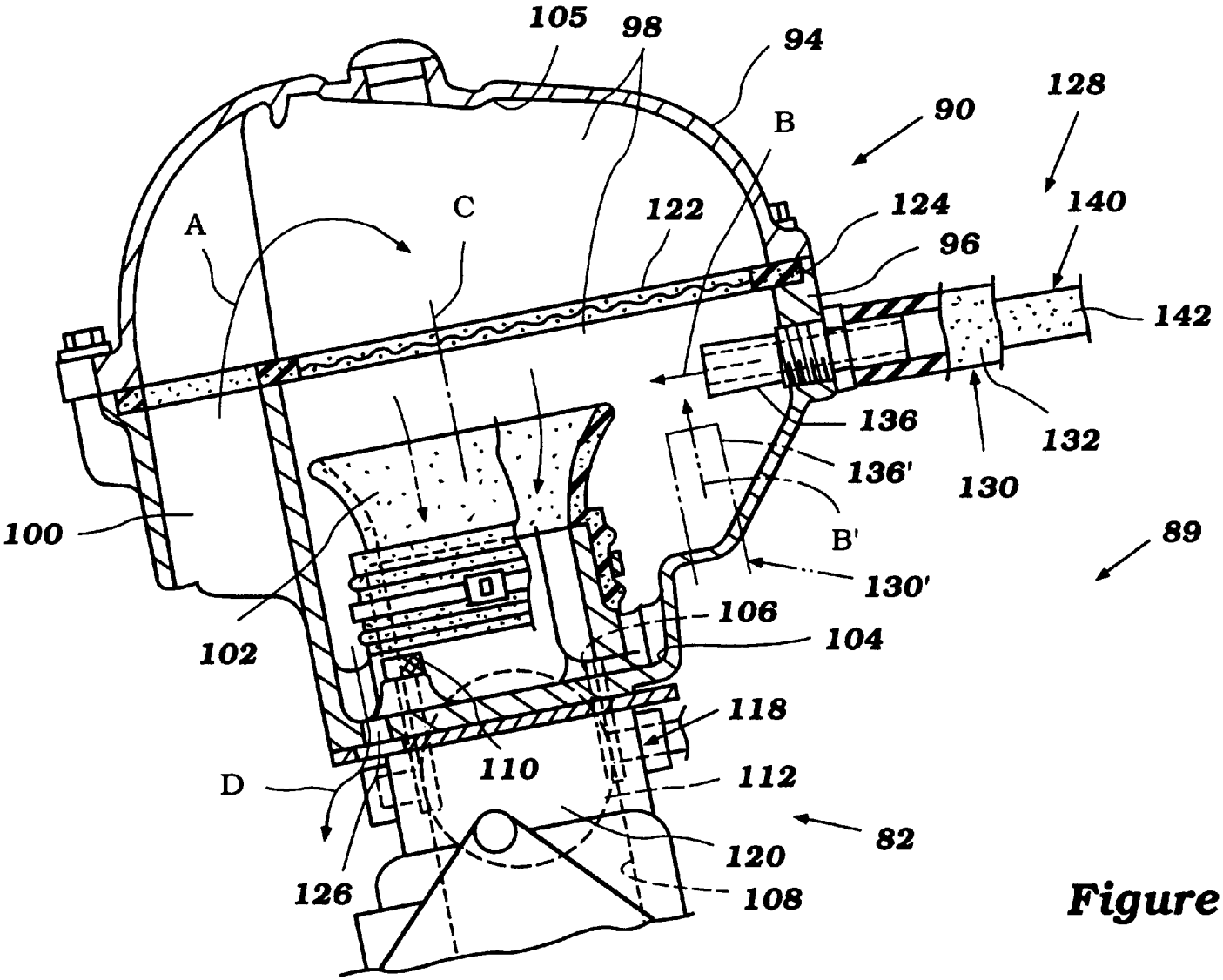
FIG. 5 is a cross-sectional view of the intake system illustrated in FIG. 4.

Referring to FIGS. 3–5, the engine 22 includes means for providing an air to each cylinder 82. Preferably, air is drawn into the engine compartment 54 through one or more air ducts (not shown). Air within the engine compartment 54 is supplied to the engine 22 through an air intake system 89.

The intake system 89 preferably includes an intake or air box 90 and an intake pipe 92 or guide member extending from the box 90 to the engine body 80. As best illustrated in FIG. 5, an intake pipe 92 is provided corresponding to each cylinder 82 for providing air from the air box 90 to that cylinder.

As best illustrated in FIG. 5 the air box 90 is generally defined by a cover 94 connected to a base member 96 and cooperating therewith to define an interior chamber 98.

The base member 96 defines an intake port 100 through which air A is drawn from within the engine compartment 54 into the interior chamber 98. The base member 96 defines a bottom surface 104 of the box 90, while the cover 94 defines a top surface 105 of the box. The base member 96 and cover 94 have curved surfaces which extend towards one another to define side walls of the box 90.

An air horn 102 corresponding to each intake pipe 92 extends upwardly from the bottom surface 104 of the air box 90 into the chamber 98. As illustrated, the horn 102 is flared at a top end, and defines a passage therethrough having an outlet 106 in communication with an intake passage 108 leading through the intake pipe 92. The passage through the air horn 102 aligned with the intake passage 108 along a centerline axis C. Preferably, the air box 90 is removably connected to each intake pipe 92 by one or more fasteners 110, such as bolts.

The passage 108 through the intake pipe 92 leads to a passage in the engine body 80 leading to one of the cylinders 82. In this manner, air is routed from the air box 90 to each cylinder 82.

Preferably, means are provided for controlling the rate of the flow of air through the intake passage 108. This means includes a choke valve 112. This valve 112 is a plate which is movably positioned in the passage 108, permitting the size of the passage to be changed. A throttle valve (not shown) is preferably provided downstream of the choke valve 112. Both valves are preferably operated by an appropriate control, such as a throttle and choke control mounted near the steering handle 36.

A fuel system provides fuel to each cylinder 82 of the engine 22. Preferably, this fuel system includes a fuel tank 116 mounted in the hull 26 (see FIG. 1). Fuel is drawn from the fuel tank 116, such as by a suitable fuel pump, and in the instant case is delivered into the air passing through each intake pipe 92. In particular, a portion of each intake pipe 92 and intake passage 118 is defined by a carburetor 118 having a body 120. The carburetor 118 is positioned between the air box 90 and the engine body 80. Fuel is supplied to the carburetor 118 and delivered thereby into the air passing therethrough.

Preferably, a net-type spark arrester 122 is positioned in the air box 90 above the inlet of the air horn 102. This arrester 122 is preferably positioned between the cover 94 and the base 96 of the box 90. Preferably, a seal 124 is provided at the outer edge of the arrester 122 for sealing the arrester between the cover 94 and base 96.

In the preferred embodiment, at least one water drain 126 is provided through the bottom 104 of the air box 90 at its lowest point. As illustrated, the bottom 104 of the air box 90 is preferably sloped so that water and other material flows to the area of the bottom 104 where the drain 126 is located. The drain 126 is a passage through the bottom 104 of the box 90 through which water and other material is discharged in the direction D.

Preferably, the engine 22 is provided with a breather unit 128. As described partly above, the air and fuel charge supplied to each cylinder 82 and the exhaust of combustion may blow by the valves into the chamber under the cover 88. In addition, this same air, fuel and exhaust may blow by the piston located in each cylinder 82 into the crankcase 84. It is generally desirable to relieve this blowby gas from each of these areas. Preferably, the breather unit 128 includes at least one pipe or passage leading from the engine body 80 to the intake system 89.

In the preferred embodiment, a breather pipe 130 extends from the chamber under the head cover 88 to the intake system 89. This pipe 130 comprises a hose 132 having a passage therethrough. A first end 134 of the hose 132 is connected to the cover 88 and has an opening in communication with the chamber thereunder. A second end 136 of the hose 132 is located at the intake system 89.

Referring to FIG. 5, the second end 136 of the hose 132 defines an opening in communication with the chamber 98 of the air box 90. The second end 136 is positioned so that this opening is positioned at other than the bottom 106 or top surface 105 of the air box.

In the embodiment illustrated, the second end 136 extends through a side wall portion of the box 90 defined by the base member 96. In addition, the end 136 of the hose 132 actually extends inwardly from the member 96 into the air space in the air box 90.

In this arrangement, blowby gas B passes from the chamber under the cover 88 through the pipe 130 to the air box 90. The blowby gas B is then dispersed into the incoming air and delivered to the cylinders 82.

A second breather pipe 140 extends from the crankcase 84 to the intake system 89. This pipe 140 comprises a hose 142 which defines a passage therethrough. A first end 144 of the hose 142 defines an opening in communication with the crankcase 84. A second end 146 of the hose 142 (see FIG. 4) defines an opening which is in communication with the intake system 89. Preferably, the second end 146 is positioned so that its opening is at other than the top or bottom surfaces 105,106 of the air box 90. In the embodiment illustrated, the end 146 is positioned along the side wall defined by the base member 96. Preferably, the second end 146 extends into the chamber 98 some distance.

In this arrangement, blowby gas B passes from the crankcase 84 to the air box 90. The blowby gas B is then dispersed into the incoming air and re-delivered to the cylinders 82.

An alternate breather arrangement is illustrated in FIG. 5. As illustrated, the ends of the breather pipes may extend upwardly into the chamber 98 defined by the air box 90 instead of generally horizontally through the side wall. For example, as illustrated in phantom, the second end 136' of the breather pipe 130' leading from the cover 88 may extend upwardly through a portion of the base member 96 into the chamber.

In the above-described breather unit 128 arrangement, water is generally prevented from entering the breather unit and flowing to the engine 22. Since the openings to the breather unit 128 in the intake system 89 are not provided at the bottom 104 of the air box 90, water which collects at the bottom does not enter the breather pipe(s). In addition, since the openings are not provided at the top surface 105 of the air box 90, when the watercraft 20 is overturned and the water in the air box 90 collects on the top surface, water again does not flow into the breather pipe(s).

Water is further prevented from flowing into the breather pipes 130,140 by having their second ends 136,146 extend some distance into the air box 90. In this manner, water which flows may even flow along the side wall, such as condensation or when the watercraft is overturned, does not flow into the openings.

The drain 126 also serves to reduce the amount of water which is located in the air box 90, further aiding in preventing water from entering the breather pipes 130,140.

While the engine 22 may include a variety of components, systems and accessories, as many of them do not form a part of the invention herein, they are not illustrated. For example, the engine 22 may include a suitable lubricating system for providing lubricating oil to the various moving parts thereof and for injection with the fuel. In addition, the engine 22 may include a suitable liquid and/or air cooling system.

Figure 6:
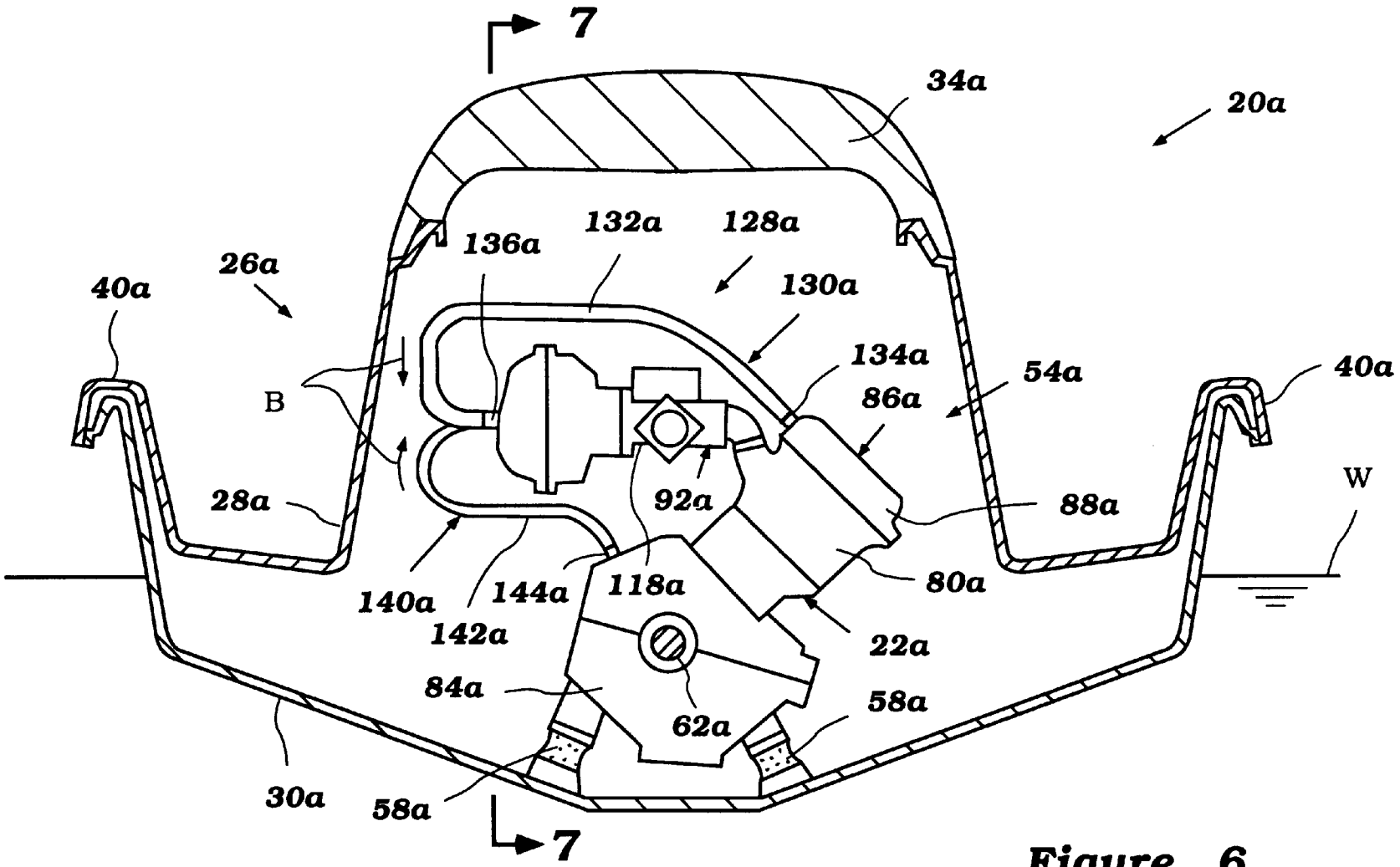
FIG. 6 is a cross-sectional end view of a watercraft powered by an engine having a breather arrangement in accordance with a second embodiment of the present invention.
Figure 7:
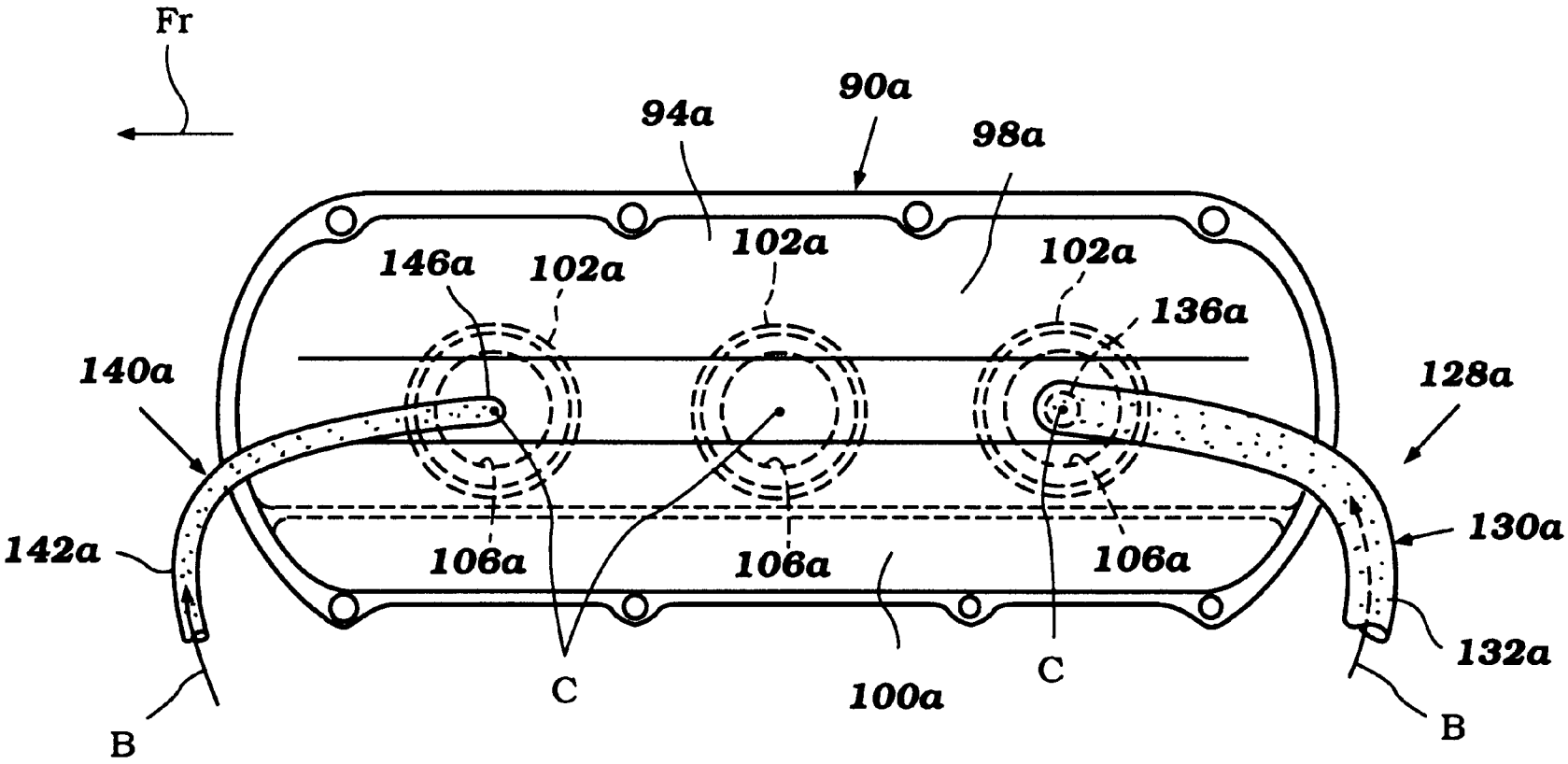
FIG. 7 is a side view of an intake system of the engine illustrated in FIG. 6 taken in the direction of line 7—7 therein.
Figure 8:
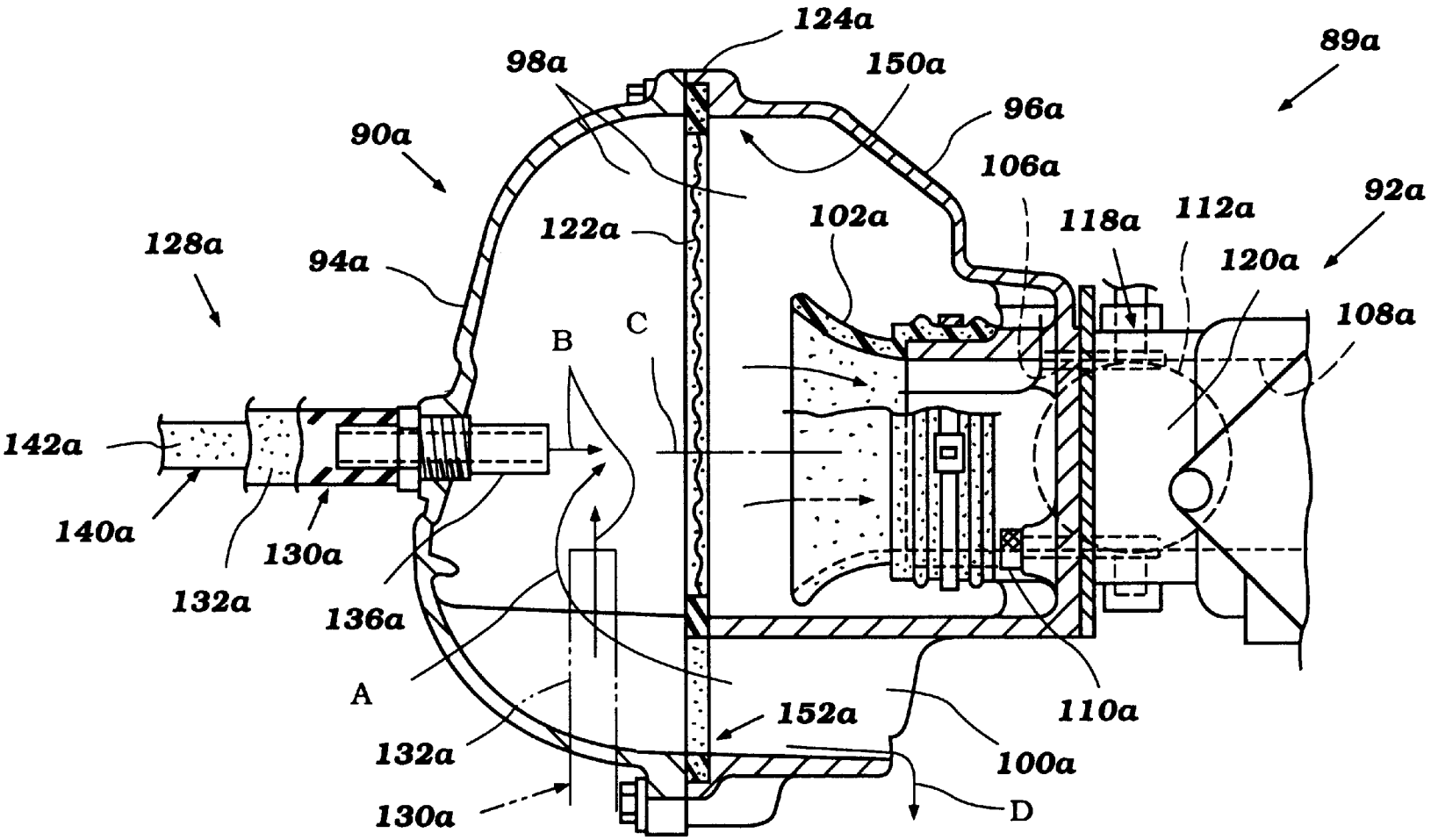
FIG. 8 is a cross-sectional view of the intake system illustrated in FIG. 7.

A breather arrangement in accordance with a second embodiment of the present invention is illustrated in FIGS. 6–8. In the description and illustration of this embodiment of the invention, like or similar parts have been given the same reference numerals as those used in the description and illustration of the previous embodiment, except that an "a" designator has been added to all the reference numerals used herein.

In this embodiment, the engine 22*a* has three cylinders and the intake system 89*a* extends in a generally horizontal plane from the engine body 80*a* (as opposed to the arranged illustrated in FIG. 3, where the intake system 89 extends generally vertically).

In this arrangement, a top (inside) surface 150*a* of the air box 90*a* is defined by the combined cover 94*a* and base member 96*a*, as is a lower or bottom surface 152*a*. Because the air intake 100*a* is provided along the bottom surface 152*a* of the air box 90*a*, the intake 100*a* may serve as a drain without the need for a separate drain.

Once again, the engine 22*a* includes a breather unit 128*a* with first and second pipes 130*a*,140*a* similar to those described above. As best illustrated in FIGS. 7 and 8, the first pipe 130*a* (extending from the cover 88*a*) has its second end 136*a* again positioned so that the opening therein is positioned at other than the top or bottom surfaces 150*a*, 152*a*, of the air box 90*a*. Preferably, the second end 136*a* extends through the cover 94*a* in alignment with one of the air horns 102*a*.

Likewise, the second end 146*a* of the second pipe 140*a* (extending from the crankcase 84*a*) is positioned so that its opening is positioned at other than the top or bottom surface 150*a*, 152*a* of the air box 90*a*, and most preferably extends into the chamber 98*a*. In the arrangement illustrated, the second end 146*a* is preferably aligned with another of the air horns 102*a*.

An alternate arrangement for the breather pipes is illustrated in phantom in FIG. 8. As illustrated therein, second end 132*a*' of the first breather pipe 130*a*' extends up from the bottom surface 152*a* of the air box 90*a*. The second end 132*a*' is positioned inside the air box 90*a*, however, with its opening above the bottom surface 152*a*. The second end of the other pipe 140*a* could be similarly positioned.

It should be understood that the breather unit of the present invention may include only a single breather pipe leading to either the crankcase or chamber under the head cover. Alternatively, the pipe may be branched, with a single pipe leading from the intake system branching to several locations.

It is also contemplated that the second end of either or both pipes of the breather unit extend to another portion of the intake system, such as the passage 108,108*a* defined through the intake pipe 92,92*a*. Again, in this fashion water which pools in the air box is generally prevented from entering the breather unit and flowing to the engine. This arrangement is less desirable in the situation where the engine includes multiple cylinders, for then charge supplied to one cylinder may differ substantially than the others since the blowby gas is not mixed with incoming air and distributed evenly to all cylinders.

While the breather pipes 130,140 have been described as hoses, they may comprise any number of elements which define a passage leading between the engine body and intake system. For example, the breather pipes may be metallic and may even comprises passages formed within the engine body and intake members themselves.

Of course, the foregoing description is that of preferred embodiments of the invention, and various changes and modifications may be made without departing from the spirit and scope of the invention, as defined by the appended claims.

What is claimed is:

1. A personal watercraft of a type that may become capsized in use, said watercraft having a hull defining an engine compartment in which a four cycle, internal combustion engine is positioned, said engine having a body defining at least one combustion chamber and having an output shaft journalled in a crankcase and arranged to drive said water propulsion device, said engine including a head cover positioned vertically above said crankcase and defining a chamber in communication with said crankcase for transfer of blowby gasses therebetween and an intake system through which air is supplied to said combustion chamber, said intake system including an air intake pipe extending from said body of said engine to an air box having a top surface and a bottom surface and an air inlet leading into an interior air space, said engine further including a breather unit including a passage leading from said engine body to an opening in fluid communication with said intake system, said opening communicating with said interior air space at a position other than at said top or bottom surface of said air box so that water that may accumulate in said air box can not flow to said engine body through said breather unit if said watercraft is either upright or inverted.

2. The personal watercraft in accordance with claim 1, wherein said breather unit comprises a pipe having a first end defining said opening, said first end extending into said interior air space of said air box.

3. The personal watercraft in accordance with claim 1, wherein a water drain is provided through said bottom surface of said air box and said opening is positioned above said drain.

4. The personal watercraft in accordance with claim 1, wherein said engine includes a cylinder head connected to a cylinder body and the head cover is connected to said cylinder head and cooperating therewith to define the chamber, said breather unit comprises a pipe having a second end leading from said chamber.

5. The personal watercraft in accordance with claim 1, wherein said passage of said breather unit extends from said crankcase to said intake system.

* * * * *